US010173851B1

(12) United States Patent
Oshiro et al.

(10) Patent No.: US 10,173,851 B1
(45) Date of Patent: Jan. 8, 2019

(54) SHEET FEED DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Toshiaki Oshiro, Izu Shizuoka (JP); Shinichi Itoh, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/709,784

(22) Filed: Sep. 20, 2017

(51) Int. Cl.
*B65H 1/04* (2006.01)
*G03G 15/00* (2006.01)

(52) U.S. Cl.
CPC ..... *B65H 1/04* (2013.01); *G03G 15/6511* (2013.01); *G03G 15/6514* (2013.01); *B65H 2402/35* (2013.01); *B65H 2402/54* (2013.01); *B65H 2404/50* (2013.01); *B65H 2407/21* (2013.01)

(58) Field of Classification Search
CPC .. B65H 1/04; B65H 2407/21; B65H 2404/50; G03G 15/6514
See application file for complete search history.

(56) References Cited

U.S. PATENT DOCUMENTS 7,444,112 B2 * 10/2008 Murakami ..... B41J 13/103 271/9.09
7,748,691 B2 * 7/2010 Mizuguchi ..... B65H 1/04 271/162
8,565,663 B2 * 10/2013 Naito ..... G03G 15/6514 271/9.09
9,188,928 B2 * 11/2015 Lee ..... G03G 21/1633
9,409,734 B2 * 8/2016 Tahara ..... B65H 1/08
9,604,806 B2 * 3/2017 Okura ..... B65H 5/26
9,725,260 B2 * 8/2017 Furusawa ..... B65H 1/04
2006/0291342 A1 * 12/2006 Kang ..... B65H 1/04 369/30.78
2009/0267283 A1 * 10/2009 Mizuguchi ..... B65H 1/04 271/3.14
2013/0032989 A1 * 2/2013 Okuchi ..... B65H 1/04 271/3.14

(Continued)

FOREIGN PATENT DOCUMENTS

JP 60-114136 A 8/1985
JP 62-111830 A 5/1987
JP 01-085339 A 6/1989

*Primary Examiner* — Patrick Cicchino
(74) *Attorney, Agent, or Firm* — Amin, Turocy & Watson LLP

(57) ABSTRACT

A sheet feed device comprises a main body section, a support section, a first link, a second link, an engagement mechanism, an energization section and a correcting section. The correcting section is movable in an approaching position at which the support section approaches the main body section against energization force of the energization section while being contactable with the second link in a direction in which the first link moves to a downstream side in the conveyance direction, and is movable in a separation position at which the support section is separated from the main body section while being separable from the second link in a direction in which the first link moves to an upstream side in the conveyance direction.

20 Claims, 13 Drawing Sheets

(56) References Cited

U.S. PATENT DOCUMENTS

| | | | | |
|---|---|---|---|---|
| 2016/0052735 | A1* | 2/2016 | Tahara | B65H 3/44<br>271/9.09 |
| 2016/0122140 | A1* | 5/2016 | Furusawa | B65H 1/04<br>271/147 |
| 2016/0332832 | A1* | 11/2016 | Okura | B65H 5/26 |
| 2017/0050811 | A1* | 2/2017 | Tateishi | B65H 1/04 |

* cited by examiner

SHEET FEED DEVICE AND IMAGE FORMING APPARATUS

FIELD

Embodiments described herein relate generally to a sheet feed device and an image forming apparatus.

BACKGROUND

Conventionally, an image forming apparatus includes a sheet feed device for supplying a sheet (for example, sheet of paper). In the sheet feed device, a pressure tray (support section) is swingable with respect to a tray receiver (main body section) in a vertical direction. A sheet feed roller is arranged above the pressure tray.

When there is no sheet on the pressure tray, the pressure tray is arranged at a position where it swings downwards. An operator disposes the pressure tray at a position where the pressure tray swings upwards after placing a plurality of sheets on the pressure tray. The uppermost sheet of the plurality of sheets comes into contact with the sheet feed roller. If the sheet feed roller is rotated, the uppermost sheet is conveyed.

DETAILED DESCRIPTION

In accordance with an embodiment, a sheet feed device comprises a main body section, a sheet stack or support section, a first link, a second link, an engagement mechanism, an energization section and a correcting section. The sheet stack or support section is supported rotatably around an axis with respect to the main body section and supports a sheet. The first link is guided to move in a conveyance direction of the sheet orthogonal to the axis with respect to the main body section.

The second link is connected rotatably with respect to the first link with a conveyance orthogonal direction parallel to the axis as a shaft. The engagement mechanism comprises a first long hole and a first protrusion. The first long hole is formed in one of the support section and the second link to extend in the conveyance direction. The first protrusion is arranged on the other of the support section and the second link, and is movable along a longitudinal direction of the first long hole with respect to the first long hole while being inserted into the first long hole. The energization section is arranged at the main body section, and energizes the support section such that the support section is separated from the main body section. The correcting section is arranged at the main body section, is movable in an approaching position at which the support section approaches the main body section against energization force of the energization section while being contactable with the second link in a direction in which the first link moves to a downstream side in the conveyance direction with respect to the main body section, and is movable in a separation position at which the support section is separated from the main body section due to the energization force of the energization section while being separable from the second link in a direction in which the first link moves to an upstream side in the conveyance direction with respect to the main body section.

Hereinafter, a sheet feed device and image forming apparatus of an embodiment are described with reference to the accompanying drawings.

Figure 1:
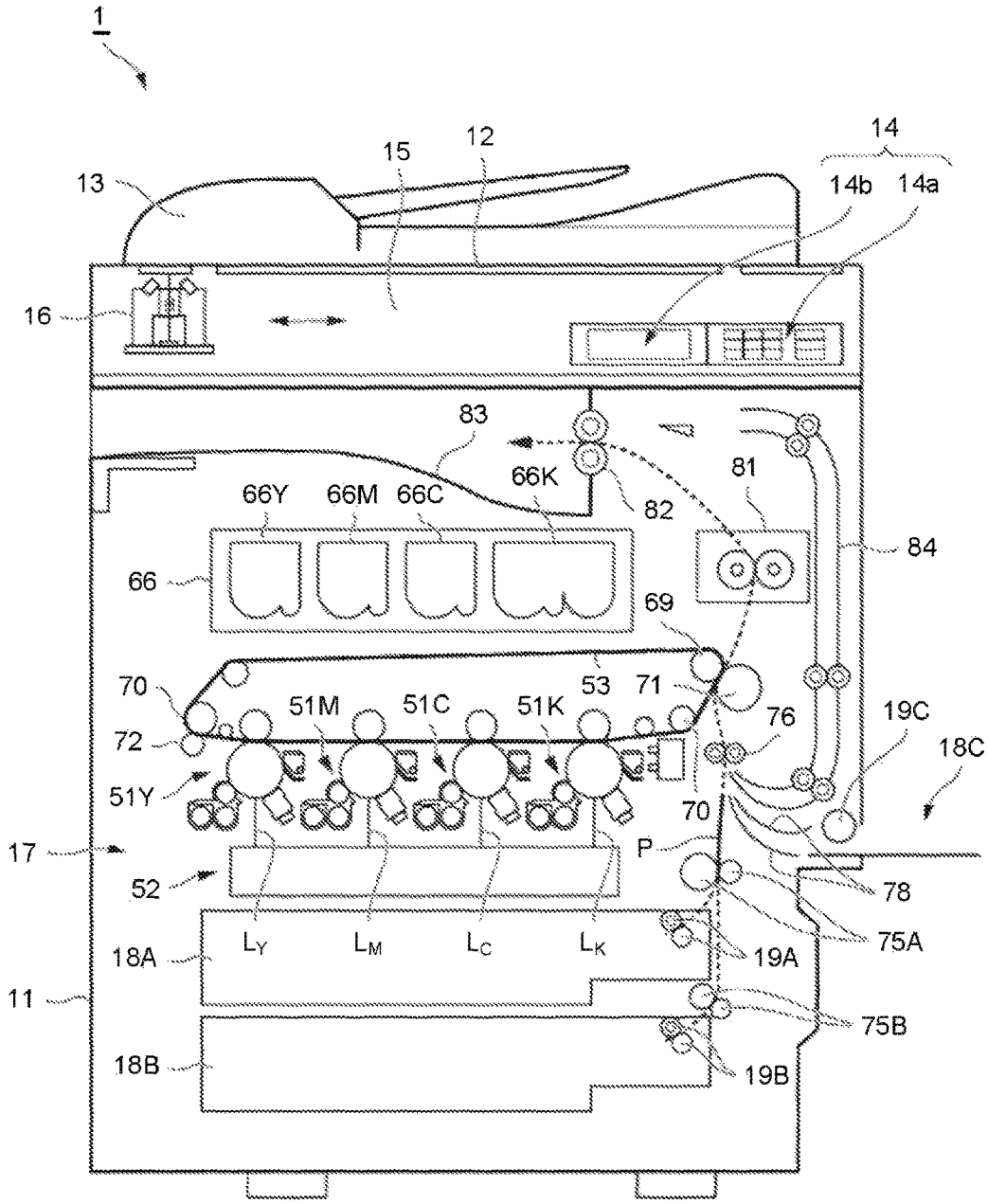
FIG. 1 is a schematic diagram of an image forming apparatus of an embodiment.

As shown in FIG. 1, an image forming apparatus 1 of the present embodiment is, for example, a MFP (Multi-Function Peripheral), a printer and a copier. Hereinafter, an example of a case in which the image forming apparatus 1 is the MFP is described.

The image forming apparatus 1 includes a main body 11. A document table 12 including transparent glass is arranged at an upper part of the main body 11. An automatic document feeder (ADF) 13 is arranged on the document table 12. An operation section 14 is arranged at an upper part of the main body 11. The operation section 14 includes an operation panel 14*a* having various keys and a touch panel type operation and display section 14*b*.

A scanner section 15 is arranged at a lower part of the ADF 13. The scanner section 15 reads a document sent by the ADF 13 or a document placed on the document table 12. The scanner section 15 generates image data of the document. For example, the scanner section 15 includes an image sensor 16. For example, the image sensor 16 may be a contact type image sensor.

The image sensor 16 moves along the document table 12 in the case of reading an image of a document placed on the document table 12. The image sensor 16 reads a document image line by line and thus reads a document of one page.

The image sensor 16 reads, in the case of reading an image of a document sent by the ADF 13, the sent document at a fixed position shown in FIG. 1.

The main body 11 includes a transfer section 17 at a central part in the height direction. The main body 11 includes sheet feed cassettes 18A and 18B at a lower part thereof and a manual sheet feed unit (sheet feed device) 18C of the present embodiment.

The sheet feed cassettes 18A and 18B are arranged inside the main body 11. The sheet feed cassettes 18A and 18B are arranged overlapped in this order from the upper side to the lower side.

The manual sheet feed unit 18C protrudes to a side of the main body 11 below a reversal conveyance route 84 described later.

The sheet feed cassettes 18A and 18B and the manual sheet feed unit 18C house various sizes of sheets (papers) P. Central axes of various sizes of sheets P in a conveyance orthogonal direction serving as a direction orthogonal to a conveyance direction of the sheets P along conveyance surfaces of the sheets P are aligned at a fixed position. Furthermore, in FIG. 1, coordinates of the conveyance direction and the conveyance orthogonal direction are not shown.

The sheet feed cassette 18A (18B) includes a sheet feed mechanism 19A (19B). Furthermore, that the sheet feed cassette 18A (18B) includes the sheet feed mechanism 19A (19B) means that the sheet feed cassette 18A includes the sheet feed mechanism 19A and the sheet feed cassette 18B includes the sheet feed mechanism 19B. This is the same even in the following description.

The sheet feed mechanism 19A (19B) picks up sheets P one by one from the sheet feed cassette 18A (18B) to send the picked up sheets P in a conveyance route of the sheets P. For example, a pickup roller, a separation roller and a sheet feed roller may be included in the sheet feed mechanism 19A (19B).

The manual sheet feed unit 18C includes a manual sheet feed mechanism 19C. The manual sheet feed mechanism 19C picks up sheets P one by one from the manual sheet feed unit 18C to send the picked up sheets P in a conveyance route.

Figure 2:
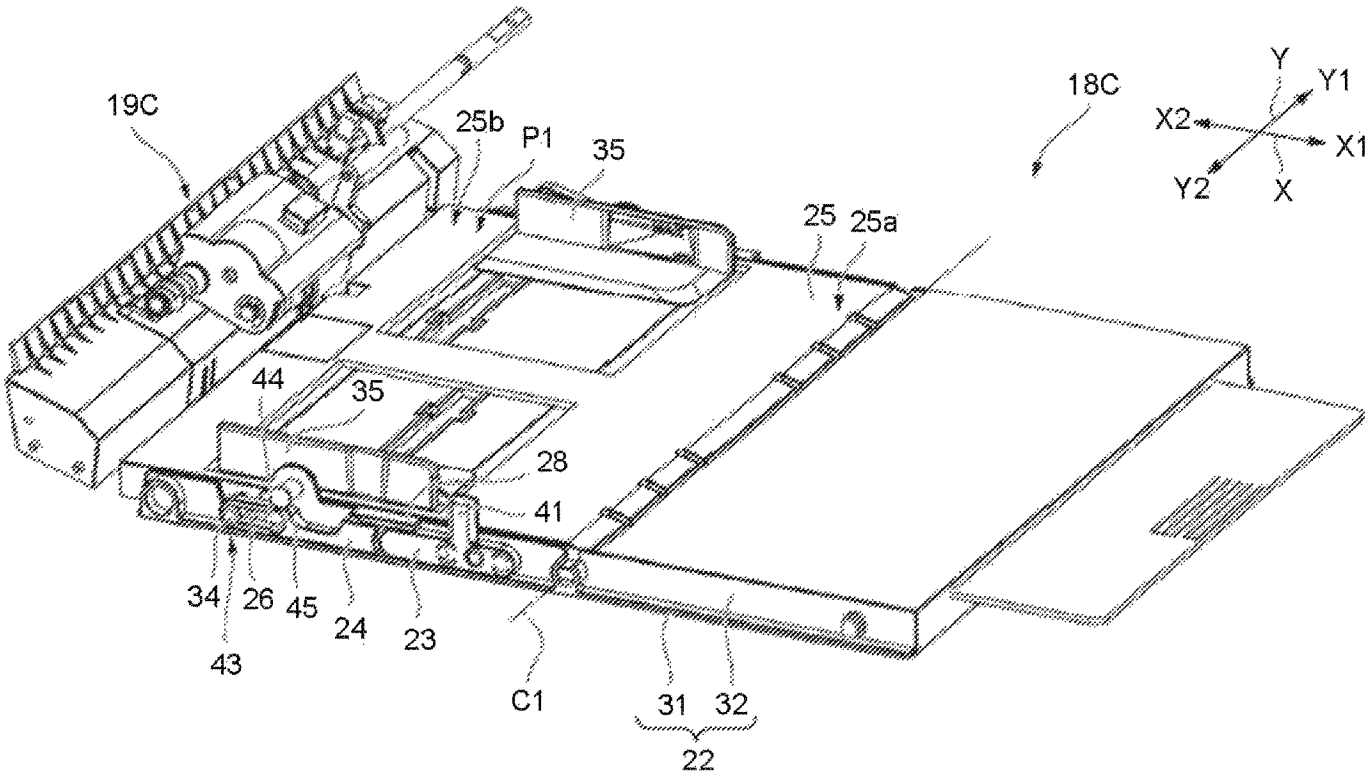
FIG. 2 is a perspective view of a manual sheet feed unit.
Figure 3:
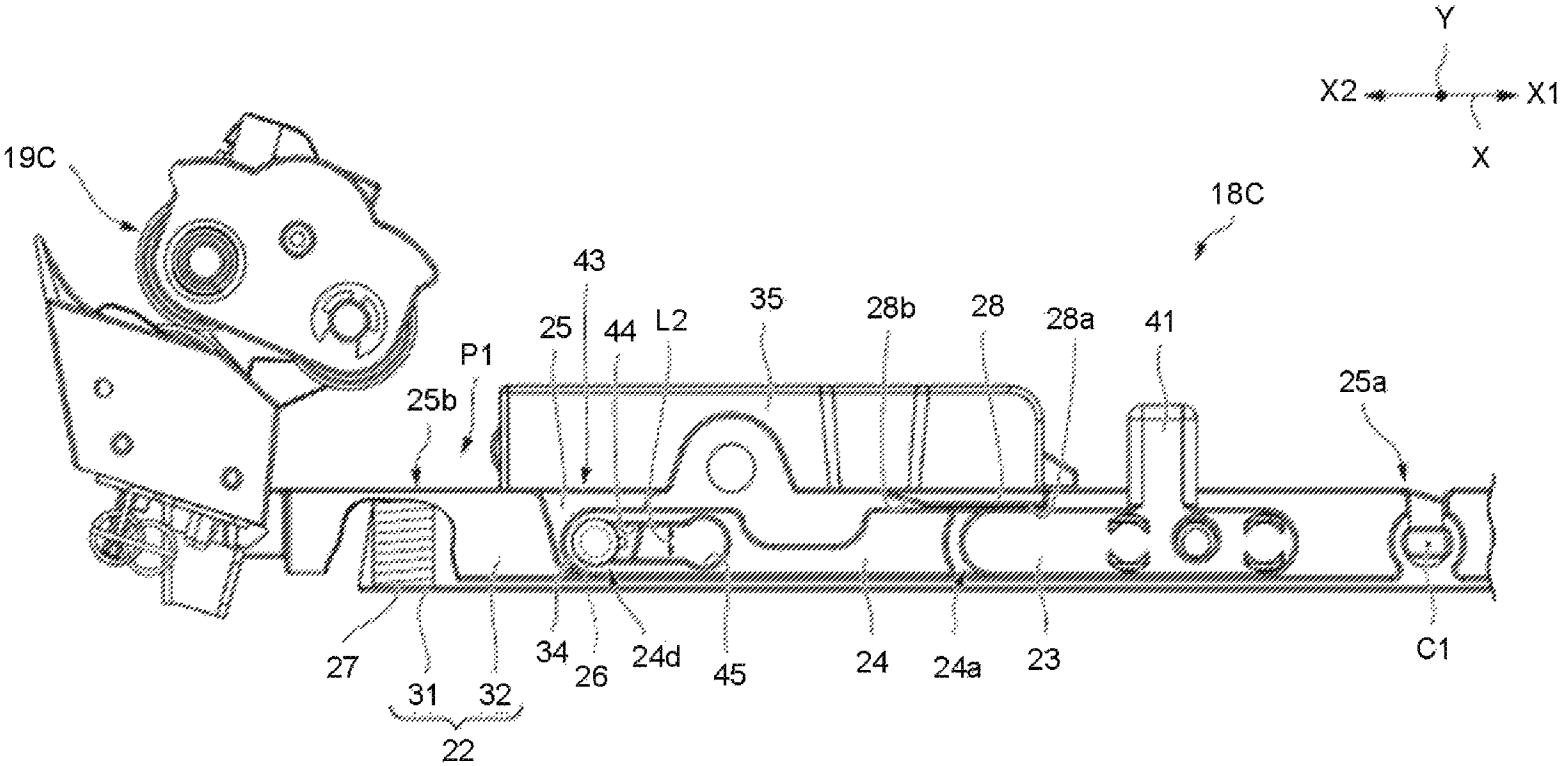
FIG. 3 is a side view of main portion of the manual sheet feed unit.

As shown in FIG. 2 and FIG. 3, the manual sheet feed unit 18C includes a tray receiver (main body section) 22, a lever (first link) 23, a link (second link) 24, a pressure tray (support section) 25, a tray side protrusion (first protrusion) 26, a spring (energization section) 27 and a correcting section 28. Furthermore, FIG. 2 to FIG. 7 illustrate a state where an under-mentioned second end part 25*b* of the pressure tray 25 moves to an approaching position P1 approaching the tray receiver 22.

The tray receiver 22 includes a bottom wall 31 and a side wall 32. The tray receiver 22 is formed in a bottomed angular cylindrical shape. For example, the bottom wall 31 is of a rectangular plate shape respectively having outer edge portions extending along a conveyance direction X of the sheet P and outer edge portions extending along a conveyance orthogonal direction Y orthogonal to the conveyance direction X. The bottom wall 31 is arranged along a substantially horizontal plane. The side wall 32 is formed in a plate shape, and is arranged on each of the outer edge portions of the bottom wall 31 in the conveyance orthogonal direction Y.

Figure 4:
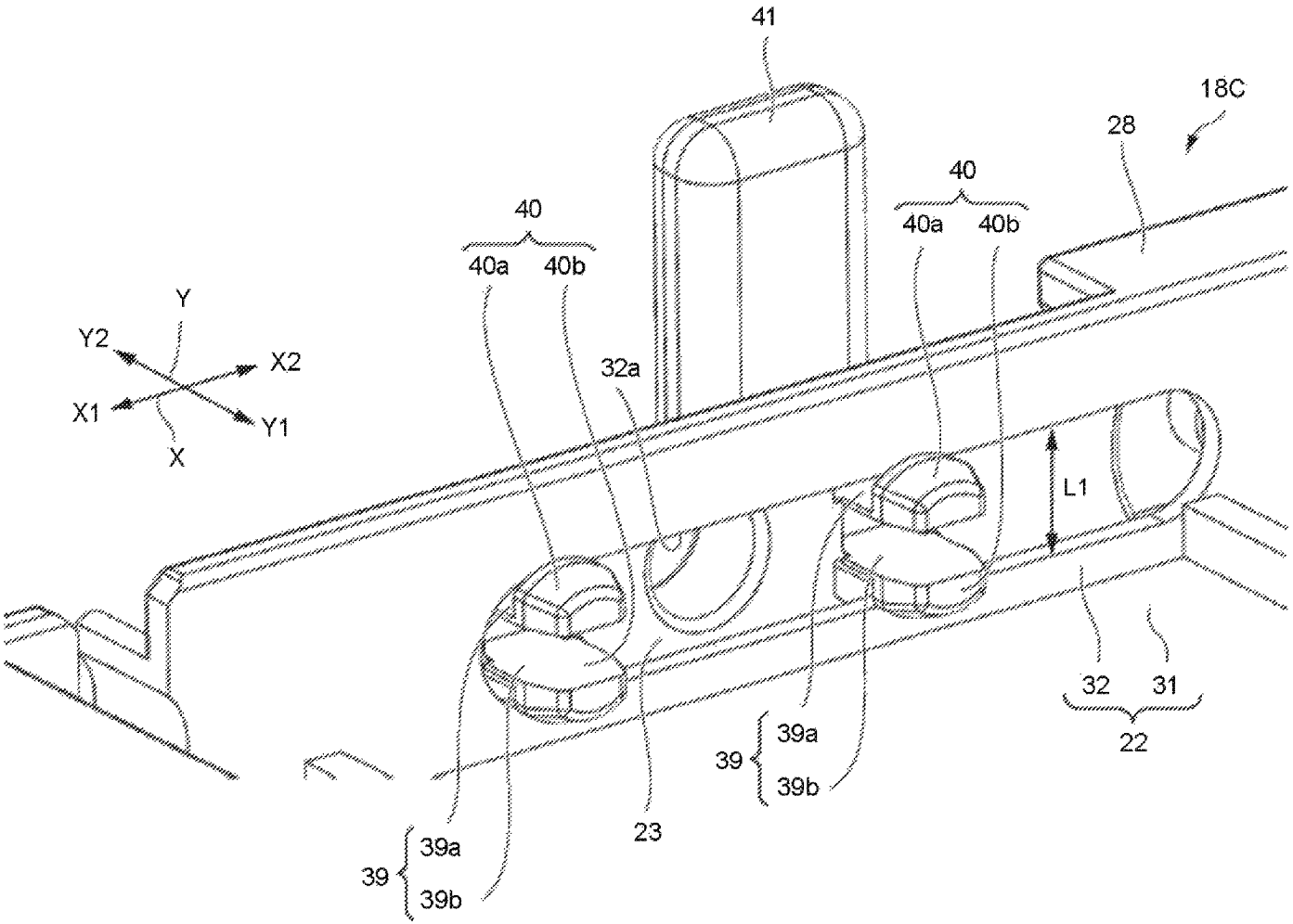
FIG. 4 is a perspective view of a periphery of a tray side long hole of a tray receiver.

As shown in FIG. 4, a tray side long hole (second long hole) 32*a* extending in the conveyance direction X is formed in the side wall 32. The tray side long hole 32*a* penetrates the side wall 32 in the conveyance orthogonal direction Y. The correcting section 28 is fixed on an end part of the side wall 32 at an upstream side X2 of the tray side long hole 32*a* in the conveyance direction X. As shown in FIG. 3, the correcting section 28 is formed in a plate shape. The correcting section 28 is fixed on the upper end part of the side wall 32 in a state where front and rear surfaces are arranged to face the vertical direction and extend in the conveyance direction X. The correcting section 28 is arranged at a higher position than the tray side long hole 32*a* (refer to FIG. 4).

An end part on a lower surface of the correcting section 28 at a downstream side X1 in the conveyance direction X is a holding surface 28*a* extending in the conveyance direction X. On the other hand, an end part on a lower surface of the correcting section 28 at the upstream side X2 in the conveyance direction X is a guide surface 28*b* which is inclined to be separated from the link 24 towards the upstream side X2 in the conveyance direction X. The guide surface 28*b* is inclined upwards gradually towards the upstream side X2 in the conveyance direction X. The holding surface 28*a* and the guide surface 28*b* each are a flat surface. The guide surface 28*b* is opposite to or contacted with the link 24.

The lower end part of the spring 27 described above is fixed on an upper surface of the bottom wall 31 at the upstream side X2 in the conveyance direction X. A helical spring is used for the spring 27. It is preferable that a plurality of springs 27 is fixed on the bottom wall 31 at intervals in the conveyance orthogonal direction Y. Each of the springs 27 expands and contracts in the vertical direction.

As shown in FIG. 2, the pressure tray 25 is formed in a plate shape. The pressure tray 25 is arranged along a substantially horizontal plane. A boss (not shown) is formed on a first end part 25*a* of the pressure tray 25 serving as an end part at the downstream side X1 in the conveyance direction X. This boss is engaged with a boss receiver (not shown) formed in the tray receiver 22. In this way, the first end part 25*a* of the pressure tray 25 is rotatably supported around an axis C1 parallel to the conveyance orthogonal direction Y with respect to the tray receiver 22. The axis C1 is orthogonal to the conveyance direction X and parallel to the conveyance orthogonal direction Y. The boss receiver of the tray receiver 22 is arranged at the downstream side X1 in the conveyance direction X with respect to the tray side long hole 32*a*, the correcting section 28 and each of the springs 27.

The tray side protrusion 26 described above is fixed on an end part of the pressure tray 25 in a second direction Y2 in the conveyance orthogonal direction Y. For example, the tray side protrusion 26 is formed in a cylindrical shape with the conveyance orthogonal direction Y as an axis. The tray side protrusion 26 is arranged closer to the second end part 25*b* of the pressure tray 25 than the first end part 25*a*. In the pressure tray 25, the second end part 25*b* is arranged at the upstream side X2 in the conveyance direction X with respect to the first end part 25*a*.

A tray side engagement section (first engagement section) 34 is formed on an end part of the tray side protrusion 26 in the second direction Y2 in the conveyance orthogonal direction Y. For example, the tray side engagement section 34 is formed in a circular plate shape and arranged coaxially with the tray side protrusion 26. The outer diameter of the tray side engagement section 34 is larger than the outer diameter of the tray side protrusion 26.

It is preferable that a pair of horizontal alignment plates 35 is mounted on the pressure tray 25. Each of the horizontal alignment plates 35 is movable in the conveyance orthogonal direction Y with respect to the pressure tray 25. The pressure tray 25 supports the sheet P at the upper surface. The sheet P is sandwiched between the pair of horizontal alignment plates 35.

The upper end part of the spring 27 described above is fixed on the lower surface of the second end part 25*b* of the pressure tray 25. The spring 27 energizes the second end part 25*b* of the pressure tray 25 upwards such that the pressure tray 25 is separated from the tray receiver 22.

Figure 5:
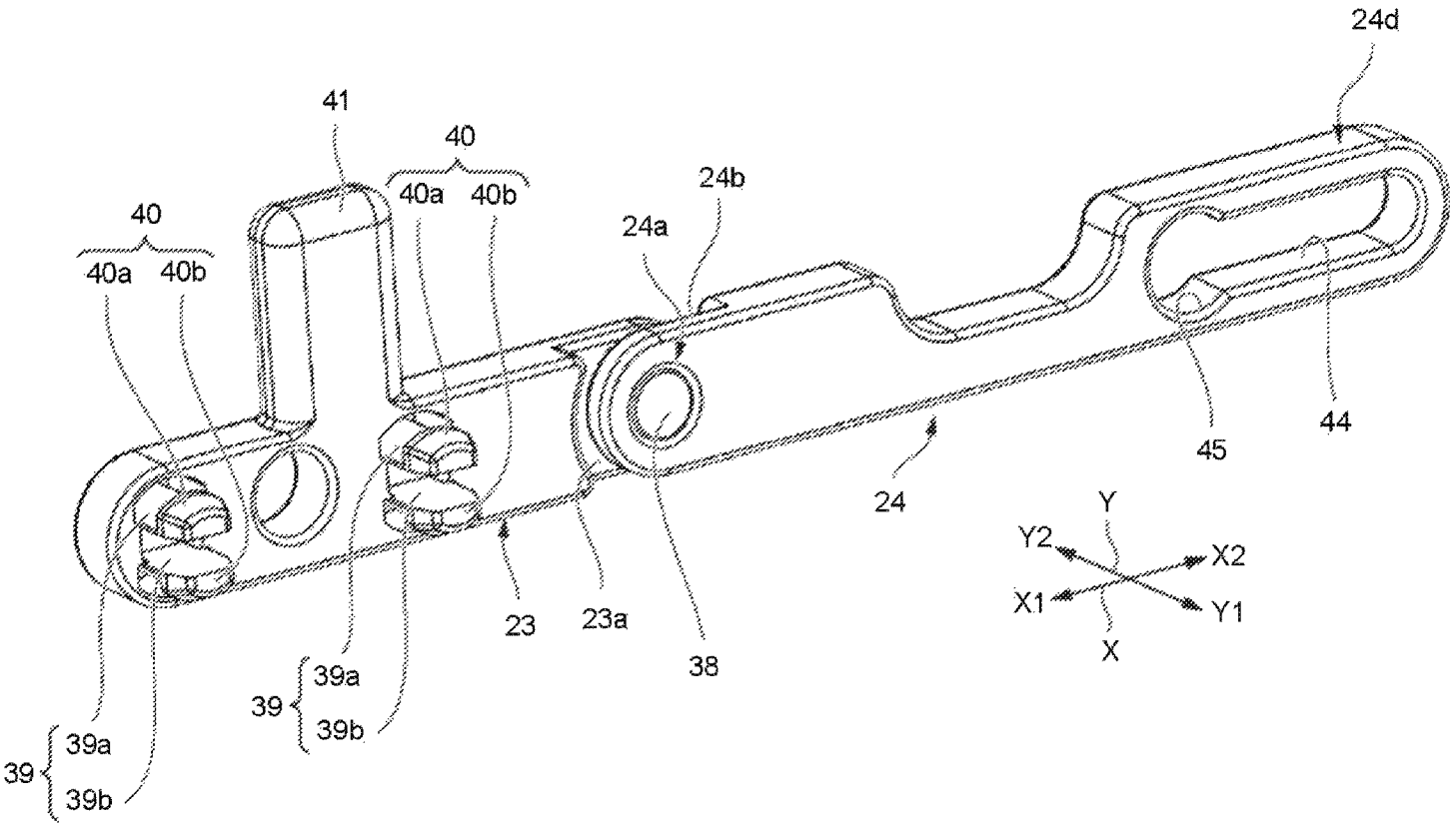
FIG. 5 is a perspective view of a lever and a link.
Figure 6:
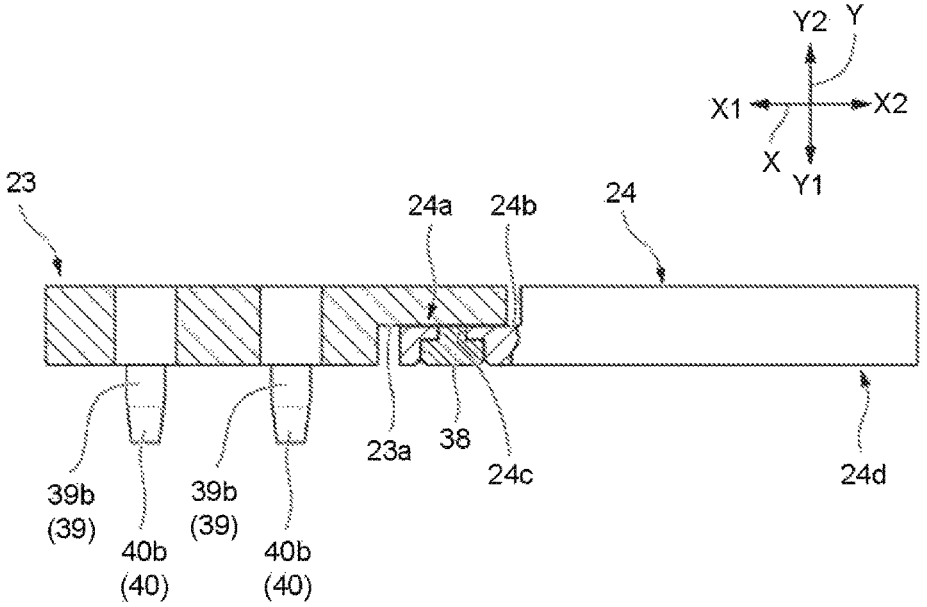
FIG. 6 is a plan view of a broken portion of the lever and the link.

As shown in FIG. 3 and FIG. 5, the lever 23 is formed in a plate shape extending in the conveyance direction X. Front and rear surfaces of the lever 23 faces the conveyance orthogonal direction Y. As shown in FIG. 5 and FIG. 6, an end part in the first direction Y1 in the conveyance orthogonal direction Y of an end part of the lever 23 at the upstream side X2 in the conveyance direction X is recessed in the second direction Y2 in the conveyance orthogonal direction Y, such that a segment portion 23*a* is formed at this end part. A shaft member 38 expanded at the front end is fixed on a bottom surface of the segment portion 23*a*. The shaft member 38 extends along the conveyance orthogonal direction Y. The end part of the lever 23 at the upstream side X2 in the conveyance direction X is a part connected with the link 24.

Two lever side protrusions (second protrusions) 39 are arranged side by side in the conveyance direction X on an end part of the lever 23 at the downstream side X1 in the conveyance direction X. Furthermore, the number of the lever side protrusions 39 arranged on the lever 23 is not limited to two, and may be three or more.

The lever side protrusion 39 includes an upper side protruding piece 39*a* arranged at the upper part and a lower side protruding piece 39*b* arranged at the lower part. The upper side protruding piece 39*a* and the lower side protruding piece 39*b* are arranged spaced apart from each other in the vertical direction. When viewed along the conveyance orthogonal direction Y, the upper side protruding piece 39*a* and the lower side protruding piece 39*b* are of semicircular shapes protruding upwards and downwards respectively. The overall outer shape of the lever side protrusion 39 is a cylindrical shape. The outer diameter of the lever side protrusion 39 (length in the vertical direction) is smaller than a short diameter L1 (inner diameter in the vertical direction, refer to FIG. 4) of the tray side long hole 32*a* of the tray receiver 22. The direction along the short diameter L1 of the tray side long hole 32*a* is the vertical direction. The lever side protrusion 39 is movable along the conveyance direction X with respect to the tray side long hole 32*a* while being inserted into the tray side long hole 32*a*. The lever 23 is guided by both of the lever side protrusion 39 and the tray side long hole 32*a* to move in the conveyance direction X with respect to the tray receiver 22.

Figure 7:
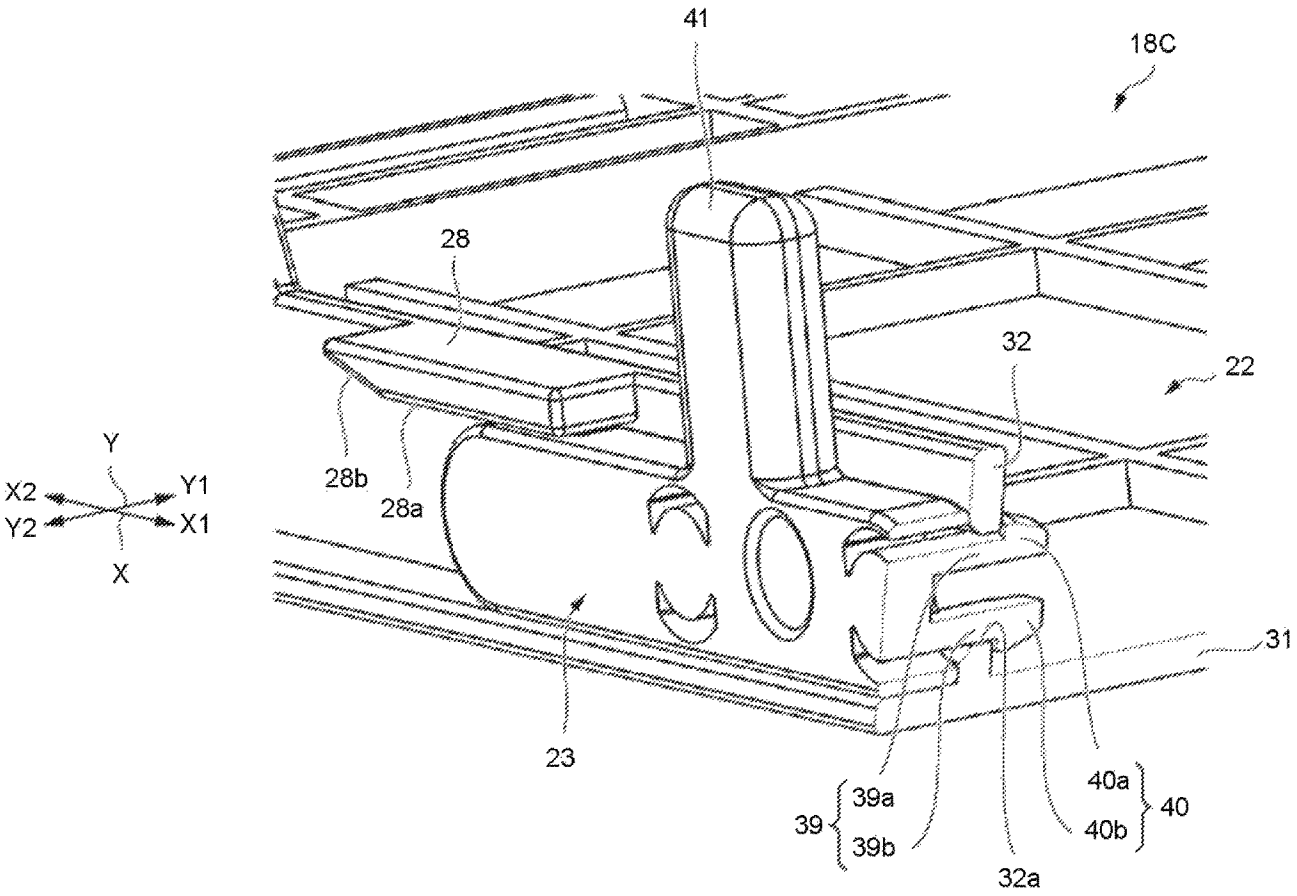
FIG. 7 is a cross-sectional view illustrating of a lever side engagement section.

A lever side engagement section (second engagement section) 40 is formed at an end part of the lever side protrusion 39 in the first direction Y1 in the conveyance orthogonal direction Y. The lever side engagement section 40 includes an upper side engagement piece (first engagement piece) 40*a* formed on the upper side protruding piece 39*a* and a lower side engagement piece (second engagement piece) 40*b* formed on the lower side protruding piece 39*b*. The upper side engagement piece 40*a* and the lower side engagement piece 40*b* are arranged spaced apart from each other in the vertical direction. The upper side engagement piece 40*a* protrudes upwards from the upper side protruding piece 39*a*. The lower side engagement piece 40*b* protrudes downwards from the lower side protruding piece 39*b*. Overall lengths of the upper side engagement piece 40*a* and the lower side engagement piece 40*b* in the vertical direction are longer than the short diameter L1 of the tray side long hole 32*a*. Thus, as shown in FIG. 7, the lever side engagement section 40 is locked in the second direction Y2 in the conveyance orthogonal direction Y with respect to the side wall 32 of the tray receiver 22. Furthermore, the link 24 is not shown in FIG. 7. The lever side engagement section 40 is impossibly inserted (cannot be inserted) into the tray side long hole 32*a*, and is locked in the conveyance orthogonal direction Y with respect to the side wall 32.

The side wall 32 is sandwiched by the lever 23 and the lever side engagement section 40 in the conveyance orthogonal direction Y. In a direction in which the upper side engagement piece 40*a* and the lower side engagement piece 40*b* are moved so as to approach each other in the vertical direction, since the upper side protruding piece 39*a* and the lower side protruding piece 39*b* are bent in the vertical direction, the overall lengths of the upper side engagement piece 40*a* and the lower side engagement piece 40*b* in the vertical direction become shorter than the short diameter L1 of the tray side long hole 32*a*. In other words, the lever side engagement section 40 can be inserted into the tray side long hole 32*a*.

As shown in FIG. 5, a knob (locking protrusion) 41 protruding from the lever 23 towards the upper part is formed on an upper surface of the lever 23. In this example, the knob 41 is formed in the vicinity of the lever side protrusion 39 of a pair of lever side protrusions 39 at the upstream side X2 in the conveyance direction X.

As shown in FIG. 5 and FIG. 6, the link 24 is formed in a plate shape extending in the conveyance direction X. Front and rear surfaces of the link 24 faces the conveyance orthogonal direction Y. The thicknesses of the link 24 (length in the conveyance orthogonal direction Y) and the thicknesses of the lever 23 are equal to each other.

An end part of a first end part 24*a* in the second direction Y2 in the conveyance orthogonal direction Y is recessed in the first direction Y1, such that a segment portion 24*b* is formed at this end part, the first end part 24*a* being an end part of the link 24 at the downstream side X1 in the conveyance direction X. The first end part 24*a* of the link 24 is a part of the link 24 connected with the lever 23.

An engagement hole 24*c* which penetrates the first end part 24*a* in the conveyance orthogonal direction Y is formed in a bottom surface of the segment portion 24*b*. The segment portion 24*b* of the link 24 and the segment portion 23*a* of the lever 23 are engaged in the conveyance orthogonal direction Y. The shaft member 38 is inserted into the engagement hole 24*c* of the link 24. The link 24 is rotatable around the shaft member 38. The shaft member 38 is locked to the peripheral portion of the opening of the engagement hole 24*c* in the link 24 in the second direction Y2 in the conveyance orthogonal direction Y. In this way, the first end part 24*a* of the link 24 is rotatably connected with the lever 23 with the conveyance orthogonal direction Y as an axis.

As shown in FIG. 3, a link side long hole (first long hole) 44 extending in the conveyance direction X is formed in the second end part 24*d* of the link 24. An engagement mechanism 43 is constituted by the link side long hole 44 and the tray side protrusion 26. The link side long hole 44 extends in the longitudinal direction of the link 24. The short diameter L2 of the link side long hole 44 (inner diameter in the vertical direction) is greater than the outer diameter of the tray side protrusion 26 and smaller than the outer diameter of the tray side engagement section 34. The link 24 is sandwiched by the tray side engagement section 34 and the pressure tray 25 in the conveyance orthogonal direction Y.

In the link 24, a large-diameter hole 45 is formed in an end part of the link side long hole 44 at the downstream side X1 in the conveyance direction X. The large-diameter hole 45 is of a circular shape when viewed along the conveyance orthogonal direction Y. The link side long hole 44 and the large-diameter hole 45 communicate with each other and penetrate the link 24 in the conveyance orthogonal direction. The inner diameter of the large-diameter hole 45 is larger than the short diameter L2 of the link side long hole 44. The tray side protrusion 26 of the pressure tray 25 described above is inserted into the link side long hole 44 of the link 24. The tray side protrusion 26 is movable with respect to the link side long hole 44 along the longitudinal direction of the link side long hole 44. The tray side engagement section 34 described above cannot be inserted into the link side long hole 44 (is locked to the link 24), but can be inserted into the large-diameter hole 45.

The transfer section 17 forms an image on the sheet P on the basis of image data read by the scanner section 15 or image data created by a personal computer. The transfer section 17 is, for example, a color printer based on a tandem system.

As shown in FIG. 1, the transfer section 17 includes image forming sections 51Y, 51M, 51C and 51K of respective colors of Yellow (Y), magenta (M), cyan (C), black (K), an exposure device 52 and an intermediate transfer belt 53. In the present embodiment, the transfer section 17 includes four image forming sections 51Y, 51M, 51C and 51K. The transfer section 17 includes a so-called quadruple image forming section.

Furthermore, the constitution of the transfer section 17 is not limited to this, the transfer section may have two or three image forming sections, or the transfer section may have five or more image forming sections.

The image forming sections 51Y, 51M, 51C and 51K are arranged below the intermediate transfer belt 53. The image forming sections 51Y, 51M, 51C and 51K are arranged in parallel from the upstream side along the downstream side in a moving direction (in a direction from the left side to the right side shown) below the intermediate transfer belt 53.

The exposure device 52 irradiates exposure light $L_Y$, $L_M$, $L_C$ and $L_K$ to the image forming sections 51Y, 51M, 51C and 51K, respectively. The exposure device 52 may be constituted in such a way to generate a laser scanning beam as exposure light. The exposure device 52 may include a solid-state scanning element such as an LED (Light Emitting Diode) that generates exposure light.

The constitutions of the image forming sections 51Y, 51M, 51C and 51K are common to each other except that colors of toner are different. As the toner, one of normal color toner and decoloring toner may be used. Herein, the decoloring toner refers to toner which becomes transparent if heated at a temperature equal to or greater than a predetermined temperature. The image forming apparatus 1 may be an image forming apparatus which can use the decoloring toner, or an image forming apparatus which cannot use the decoloring toner.

Hereinafter, the common constitution of the image forming sections 51Y, 51M, 51C and 51K is described in an example of the image forming section 51K.

Figure 8:
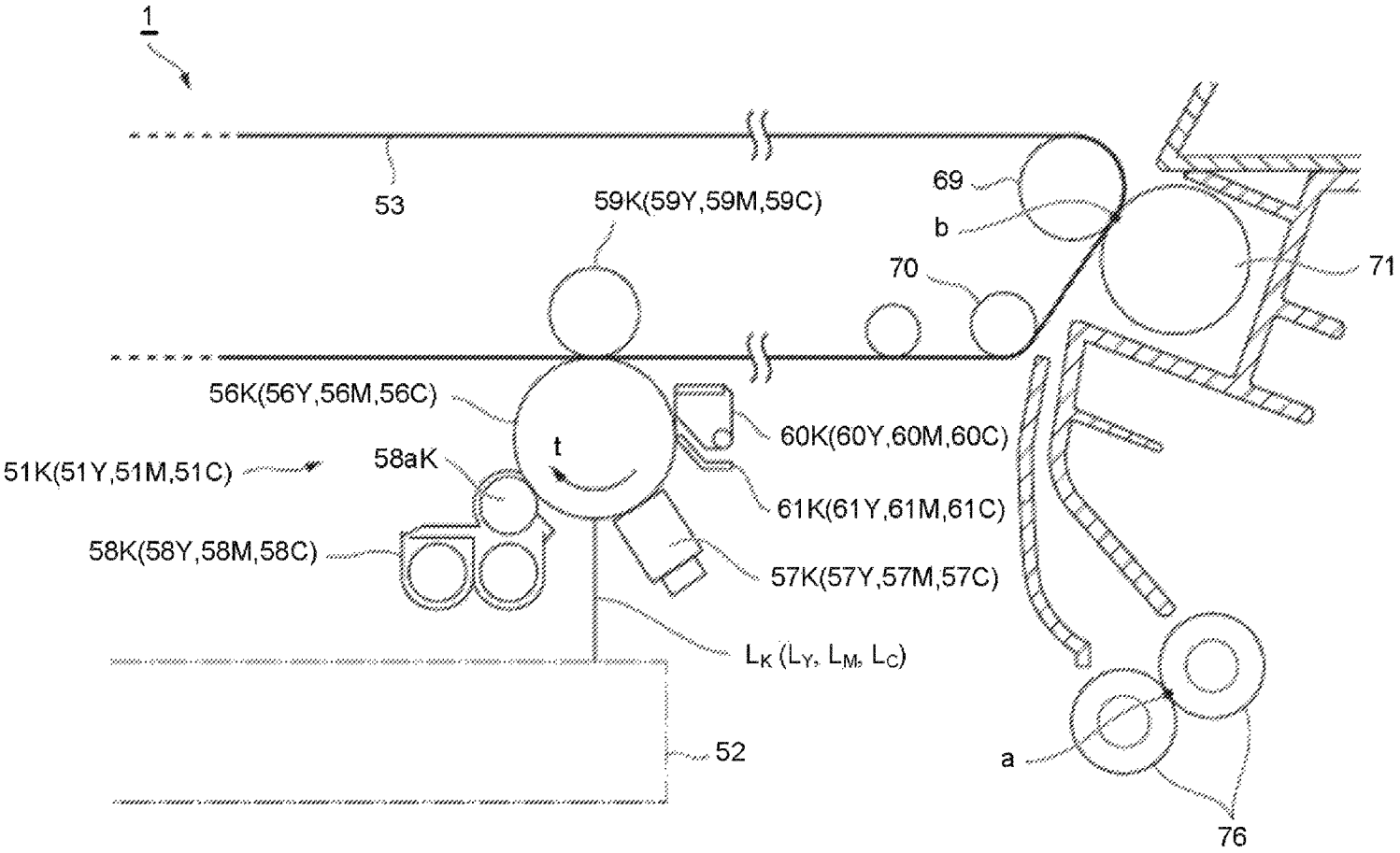
FIG. 8 is a schematic diagram of an enlarged portion of the image forming apparatus.

As shown in FIG. 8, the image forming section 51K includes a photoconductive drum 56K. The photoconductive drum 56K rotates in a rotation direction t. A charger 57K, a developing device 58K, a primary transfer roller 59K and a cleaner 60K are arranged around the photoconductive drum 56K in the rotation direction t.

The charger 57K of the image forming section 51K uniformly charges the surface of the photoconductive drum 56K.

The exposure device 52 generates the exposure light $L_k$ modulated on the basis of image date. The exposure light $L_k$ exposures the surface of the photoconductive drum 56K. The exposure device 52 forms an electrostatic latent image on the photoconductive drum 56K.

The developing device 58K supplies black toner to the photoconductive drum 56K by a developing roller 58*a*K to which a developing bias is applied. The developing device 58K develops the electrostatic latent image on the photoconductive drum 56K.

The cleaner 60K includes a blade 61K abutting against the photoconductive drum 56K. The blade 61K removes toner left on the surface of the photoconductive drum 56K.

The image forming sections 51Y, 51M and 51C include photoconductive drums 56Y, 56M and 56C, chargers 57Y, 57M and 57C, primary transfer rollers 59Y, 59M and 59C, cleaners 60Y, 60M and 60C and blades 61Y, 61M and 61C, similar to the photoconductive drum 56K, the charger 57K, the primary transfer roller 59K, the cleaner 60K and the blade 61K of the image forming section 51K.

The image forming sections 51Y, 51M and 51C include developing devices 58Y, 58M and 58C in which only colors of toner are different, corresponding to the developing device 58K of the image forming section 51K.

As shown in FIG. 1, a supply section 66 is arranged above the image forming sections 51Y, 51M, 51C and 51K.

The supply section 66 supplies toner to the developing devices 58Y, 58M, 58C and 58K, respectively. The supply section 66 includes toner cartridges 66Y, 66M, 66C and 66K. The toner cartridges 66Y, 66M, 66C and 66K house yellow toner, magenta toner, cyan toner and black toner, respectively.

In each of the toner cartridges 66Y, 66M, 66C and 66K, a mark section (not shown) is arranged which enables the main body 11 to detect the category of toner housed therein. The mark section includes at least information of colors of toner of the toner cartridges 66Y, 66M, 66C and 66K and information for identifying whether toner is the normal toner or the decoloring toner.

The intermediate transfer belt 53 moves circularly. The intermediate transfer belt 53 is stretched over a drive roller 69 and a plurality of driven rollers 70.

As shown in FIG. 8, the middle transfer belt 53 is in contact with the photoconductive drum 56 Y, 56 M, 56 C, 56 K from above.

The primary transfer roller 59K (59Y, 59M, 59C) is arranged at a position opposite to the photoconductive drum 56K (56Y, 56M, 56C) across the intermediate transfer belt 53 at the upper side of the photoconductive drum 56K (56Y, 56M, 56C). The primary transfer roller 59K (59Y, 59M, 59C) is arranged inside the intermediate transfer belt 53.

The primary transfer roller 59K (59Y, 59M, 59C) primarily transfers a toner image on the photoconductive drum 56K (56Y, 56M, 56C) to the intermediate transfer belt 53 if a primary transfer voltage is applied.

A secondary transfer roller 71 is opposite to the drive roller 69 across the intermediate transfer belt 53. An abutting section of the intermediate transfer belt 53 and the secondary transfer roller 71 constitutes a secondary transfer position b. The drive roller 69 drives the intermediate transfer belt 53 to rotate.

A secondary transfer voltage is applied to the secondary transfer roller 71 when the sheet P passes through the secondary transfer position b. If the secondary transfer voltage is applied to the secondary transfer roller 71, the secondary transfer roller 71 secondarily transfers the toner image on the intermediate transfer belt 53 to the sheet P.

As shown in FIG. 1, a belt cleaner 72 is arranged at a position opposite to one of the plurality of driven rollers 70 across the intermediate transfer belt 53. The belt cleaner 72 removes transfer toner remaining on the intermediate transfer belt 53 from the intermediate transfer belt 53.

A sheet feed roller 75A and a register roller 76 are arranged on a conveyance route from the sheet feed cassette 18A to the secondary transfer roller 71. The sheet feed roller 75A conveys the sheet P picked up from the sheet feed cassette 18A by the sheet feed mechanism 19A.

The register roller 76 aligns positions of front ends of the sheets P fed from the sheet feed roller 75A at an abutting position on each other. The abutting position on each other of the register roller 76 (refer to a point a in FIG. 8) constitutes a register position. The register roller 76 conveys the sheet P such that the front end of the transfer area of the toner image of the sheet P reaches the secondary transfer position b when the front end of the toner image reaches the secondary transfer position b.

As shown in FIG. 1, a sheet feed roller 75B is arranged on a conveyance route from the sheet feed cassette 18B to the sheet feed roller 75A. The sheet feed roller 75B conveys the sheet P picked up from the sheet feed cassette 18B by the sheet feed mechanism 19B towards the sheet feed roller 75A.

A conveyance route is formed by a conveyance guide 78 between the manual sheet feed mechanism 19C and the register roller 76. The manual sheet feed mechanism 19C conveys the sheet P picked up from the manual sheet feed unit 18C towards the conveyance guide 78. The sheet P moving along the conveyance guide 78 reaches the register roller 76.

A fixing section 81 is arranged at the downstream side (upper side shown) of the secondary transfer roller 71 in the conveyance direction of the sheet P. Although not shown, the fixing section 81 includes a halogen lamp and a drive motor for conveying the sheet P. The fixing section 81 fixes the toner image on the sheet P by heating the sheet P by the halogen lamp.

A conveyance roller 82 is arranged at the downstream side (upper left side shown) of the fixing section 81 in the conveyance direction of the sheet P. The conveyance roller 82 discharges the sheet P to the sheet discharge section 83.

The reversal conveyance route 84 is arranged at the downstream side (right side shown) of the fixing section 81 in the conveyance direction of the sheet P. The reversal conveyance route 84 reverses the sheet P to guide the reversed sheet P to the secondary transfer roller 71. The reversal conveyance route 84 is used at the time of execution of duplex printing.

Next, the constitution of a control section 91 of the image forming apparatus 1 is described.

Figure 9:
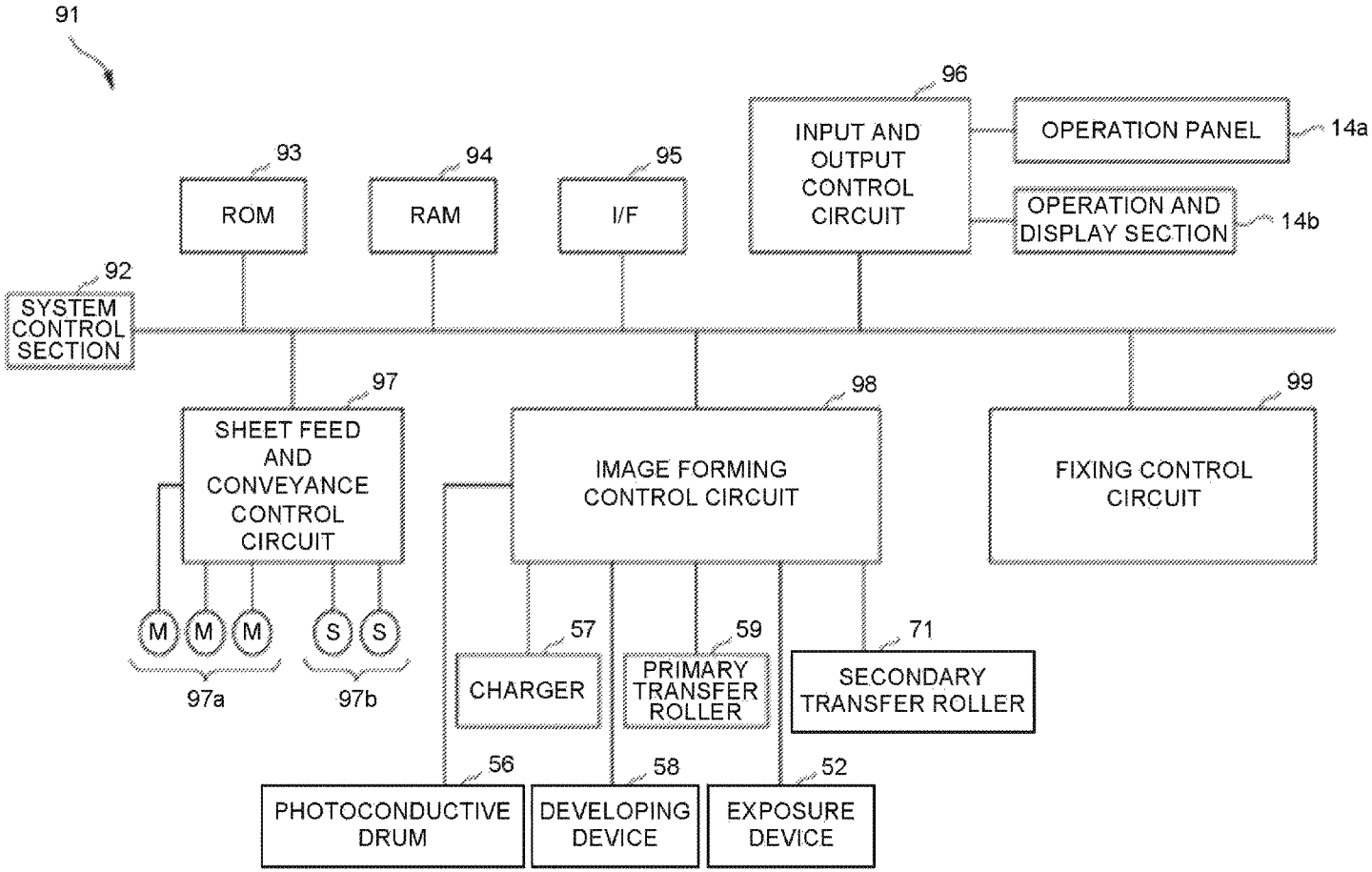
FIG. 9 is a block diagram of a control section of the image forming apparatus.

FIG. 9 is a block diagram illustrating an example of the constitution of the control section 91 of the image forming apparatus 1. However, in FIG. 9, for ease of viewing, members distinguished by subscripts Y, M, C and K are represented collectively by symbols obtained by deleting these subscripts. For example, the photoconductive drum 56 represents the photoconductive drums 56Y, 56M, 56C and 56K. The same applies to the charger 57, the developing device 58 and the primary transfer roller 59.

In the explanation with reference to FIG. 9, on the basis of the description, there is a case in which symbols in which subscripts Y, M, C and K are omitted are used.

The control section 91 includes a system control section 92, a read only memory (ROM) 93, a random access memory (RAM) 94, an interface (I/F) 95, an input and output control circuit 96, a sheet feed and conveyance control circuit 97, an image forming control circuit 98 and a fixing control circuit 99.

The system control section 92 controls the whole of the image forming apparatus 1. The system control section 92 realizes a processing function for image formation by executing a program stored in the ROM 93 or the RAM 94 described later. For example, a processor such as a CPU (Central Processing Unit) may be used as a device constitution of the system control section 92.

The ROM 93 stores a control program for controlling a basic operation of an image forming processing, and control data.

The RAM 94 is a working memory in the control section 91. For example, the control program or the control data of the ROM 93 is loaded in the RAM 94 as required. In addition, the RAM 94 temporarily stores the image data sent from the input and output control circuit 96 or the data sent from the system control section 92.

The I/F 95 carries out communication with a connection device connected to the main body 11. For example, the scanner section 15 is communicably connected to the I/F 95. Further, an external device can be connected to the I/F 95. A user terminal, a facsimile device and the like is given as an example of the external device include.

The input and output control circuit 96 controls the operation panel 14*a* and the operation and display section 14*b*. The input and output control circuit 96 sends operation inputs received from the operation panel 14*a* and the operation and display section 14*b* to the system control section 92.

The sheet feed and conveyance control circuit 97 controls a drive system included in the main body 11. For example, a drive motor 97*a* for driving the sheet feed mechanisms 19A and 19B, the sheet feed rollers 75A and 75B, the manual sheet feed mechanism 19C and the register roller 76 is included in the drive system. More preferably, it is more preferable that a plurality of drive motors 97*a* is arranged.

A plurality of sensors 97*b* is electrically connected with the sheet feed and conveyance control circuit 97. For example, a plurality of sheet detection sensors is included in the plurality of sensors 97*b*. The plurality of sheet detection sensors is arranged inside the conveyance route, the sheet feed cassettes 18A and 18B and the manual sheet feed unit 18C in the main body 11. Each of the sheet detection sensors detects presence/absence of the sheet P at the arrangement position of the sensor.

A detection output of each of the sensors 97*b* is sent from the sheet feed and conveyance control circuit 97 to the system control section 92.

The sheet feed and conveyance control circuit 97 controls the drive motor 97*a* on the basis of a control signal from the system control section 92 and a detection output of each of the sensors 97*b*.

The image forming control circuit 98 controls the photoconductive drum 56, the charger 57, the exposure device 52, the developing device 58, the primary transfer roller 59 and the secondary transfer roller 71 respectively on the basis of a control signal from the system control section 92.

The fixing control circuit 99 controls the drive motor and the halogen lamp of the fixing section 81 respectively on the basis of a control signal from the system control section 92.

Details of the control carried out by the control section 91 together with operations of the image forming apparatus 1 are described.

Herein, at the time of manufacture of the image forming apparatus 1, procedures for engaging the link 24 with the tray side protrusion 26 of the pressure tray 25 are described. The tray side engagement section 34 and the tray side protrusion 26 are inserted into the large-diameter hole 45 of the link 24. If the link 24 is moved with respect to the pressure tray 25 at the downstream side X1 in the conveyance direction X, the tray side protrusion 26 moves into the link side long hole 44 from inside the large-diameter hole 45. At this time, since the link 24 is sandwiched by the tray side engagement section 34 and the pressure tray 25 in the conveyance orthogonal direction Y, the link 24 is not detached from the pressure tray 25 in the conveyance orthogonal direction Y.

Figure 10:
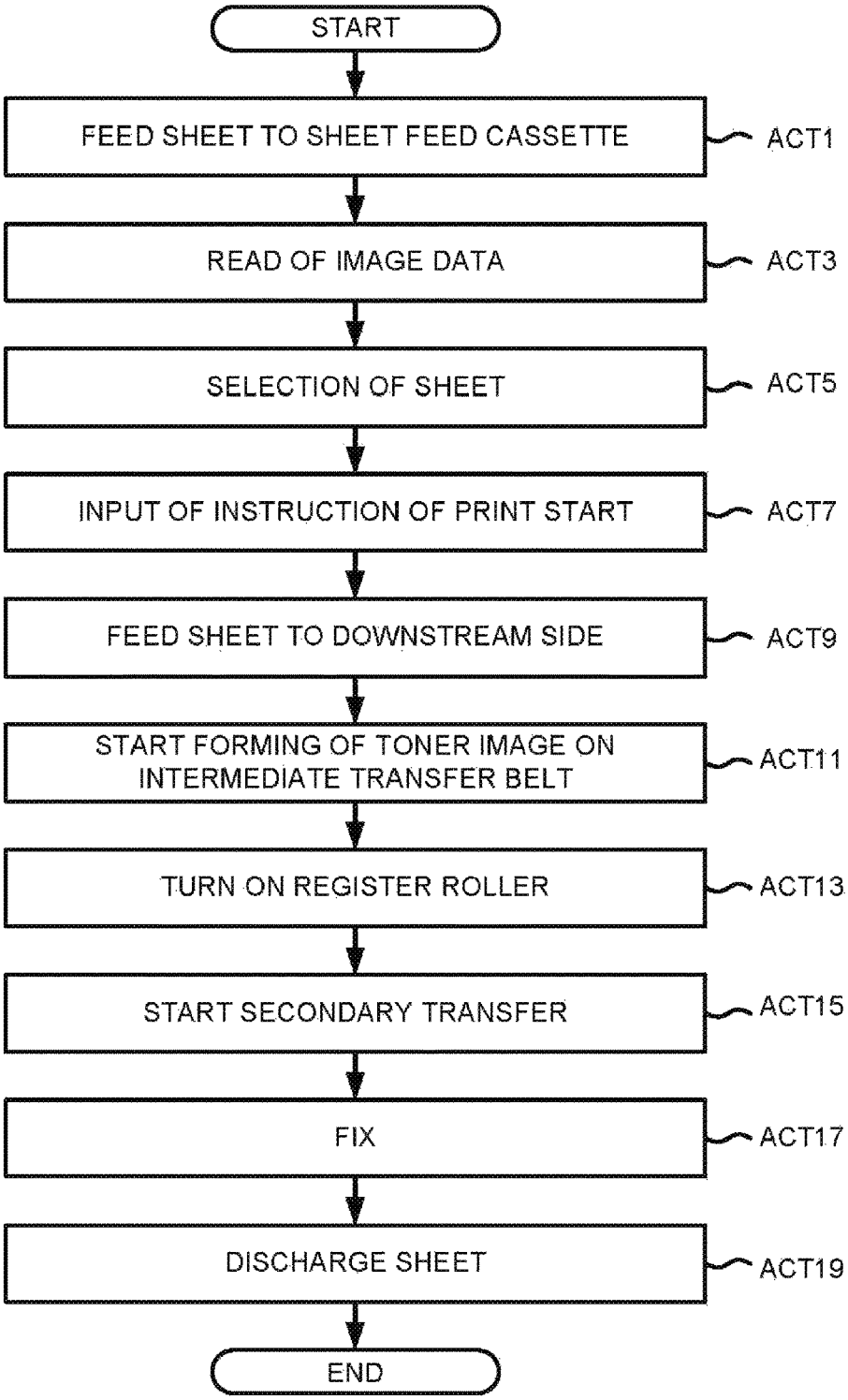
FIG. 10 is a flowchart of operations of the image forming apparatus.

Next, the operations of the image forming apparatus 1 of the present embodiment constituted as described above are described. FIG. 10 is a flowchart illustrating an example of the operations at the time of printing of the image forming apparatus 1 of the embodiment.

The image forming apparatus 1 prints an image on the sheet P by executing processing in ACT 1 to ACT 19 shown in FIG. 10 according to the flow shown in FIG. 10.

An operator feeds the sheets P to the sheet feed cassettes 18A and 18B and the manual sheet feed unit 18C (ACT 1). Hereinafter, feeding of sheets to the manual sheet feed unit 18C is described in detail. As shown in FIG. 2 and FIG. 3, in the manual sheet feed unit 18C, the lever 23 is moved to the downstream side X1 in the conveyance direction X with respect to the tray receiver 22 by operating the knob 41 in advance. For example, at this time, since the lever side protrusion 39 is arranged at an end of the tray side long hole 32*a* of the tray receiver 22 at the downstream side X1 in the conveyance direction X, the lever 23 cannot move to the downstream side X1 in the conveyance direction X with respect to the tray receiver 22. At this time, the link 24 is guided to extend along the conveyance direction X by coming into contact with the guide surface 28*b* of the correcting section 28 to rotate around the first end part 24*a* in a direction of moving together with the lever 23 to the downstream side X1 in the conveyance direction X. Then, the link 24 is kept in a state of extending along the conveyance direction X by coming into contact with the holding surface 28*a* of the correcting section 28. When the link 24 is kept in the state of extending along the conveyance direction X, the tray side protrusion 26 moves to approach the second end part 24*d* of the link 24 (to be separated from the first end part 24*a*) within the link side long hole 44 of the link 24. At this time, the tray side protrusion 26 moves downwards to approach the tray receiver 22. The second end part 25*b* of the pressure tray 25 where the tray side protrusion 26 is fixed moves to the approaching position P1 approaching the tray receiver 22 by rotation of the pressure tray 25 around the axis C1 against energization force of the spring 27. When the second end part 25*b* of the pressure tray 25 is located at the approaching position P1, the spring 27 is contracted in the vertical direction by a length greater than a natural length.

After expanding a distance between the pair of horizontal alignment plates 35, a plurality of sheets P is arranged on the pressure tray 25 in a predetermined direction. The distance between the pair of horizontal alignment plates 35 is narrowed, and the plurality of sheets P is held by the pair of horizontal alignment plates 35.

Figure 11:
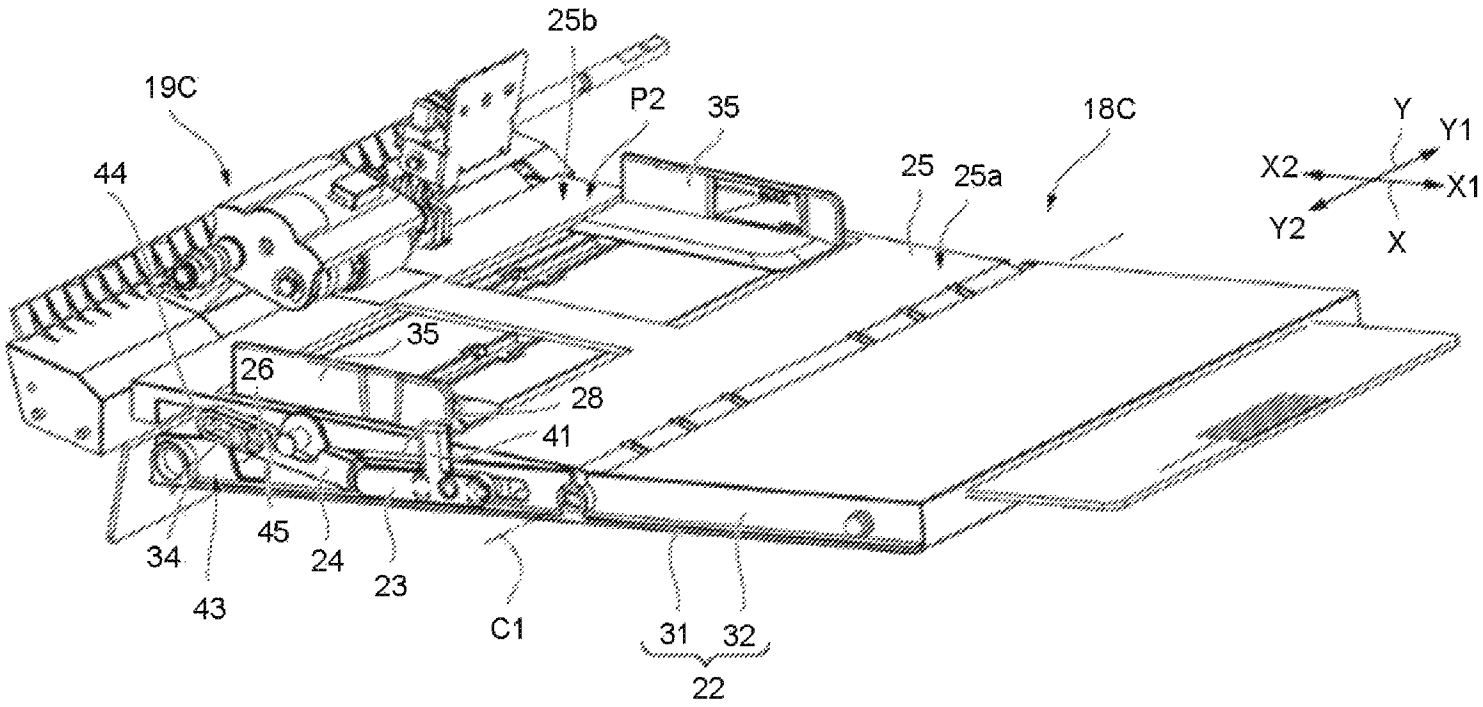
FIG. 11 is a perspective view of the manual sheet feed unit when the pressure tray moves to a separation position.
Figure 12:
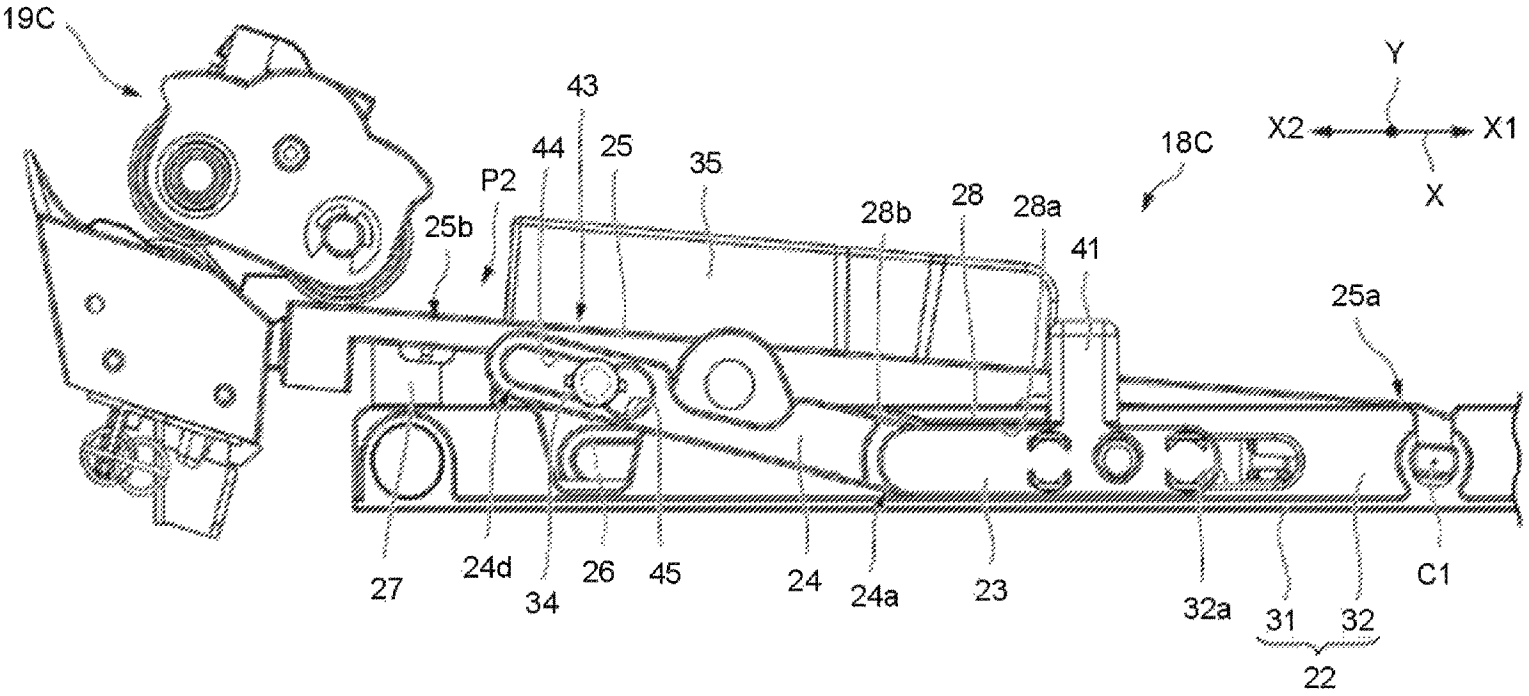
FIG. 12 is a side view of main portion of the manual sheet feed unit when the pressure tray moves to the separation position.

As shown in FIG. 11 and FIG. 12, the operator operates the knob 41 to move the lever 23 to the upstream side X2 in the conveyance direction X with respect to the tray receiver 22. The tray side protrusion 26 moves to approach the first end part 24*a* of the link 24 within the link side long hole 44 of the link 24. The link 24 moves to the upstream side X2 in the conveyance direction X with respect to the tray receiver 22 and the correcting section 28, and is separated from the correcting section 28. At this time, the link 24 is arranged in such a manner that the second end part 24*d* rotates (swing) to move upwards around the first end part 24*a* and intersects with the conveyance direction X. At this time, it is preferable that the link 24 and the guide surface 28*b* of the correcting section 28 are substantially parallel.

The tray side protrusion 26 moved upwards to be separated from the tray receiver 22. For example, at this time, since the knob 41 is locked to the correcting section 28, the lever 23 cannot further move to the upstream side X2 in the conveyance direction X with respect to the tray receiver 22. At this time, the tray side protrusion 26 does not reach the large-diameter hole 45 in the longitudinal direction of the link side long hole 44. The second end part 25*b* of the pressure tray 25 where the tray side protrusion 26 is fixed moves to a separation position P2 separating upwards from the tray receiver 22 by rotation of the pressure tray 25 around the axis C1 by the energization force of the spring 27. The plurality of sheets P on the pressure tray 25 comes into contact with the manual sheet feed mechanism 19C from below.

Furthermore, in a case in which there is no sheet P on the pressure tray 25 since the sheets P on the pressure tray 25 are used, the following procedures are carries out. In other words, the operator operates the knob 41 to move the lever 23 to the downstream side X1 in the conveyance direction X with respect to the tray receiver 22. The link 24 comes into contact with the guide surface 28*b* of the correcting section 28 to rotate around the first end part 24*a*, and is kept by the holding surface 28*a* of the correcting section 28 in a state of extending along the conveyance direction X. The tray side protrusion 26 moves to approach the second end part 24*d* of the link 24 within the link side long hole 44 of the link 24. The second end part 25*b* of the pressure tray 25 moves to the approaching position P1 approaching the tray receiver 22. The plurality of sheets P is arranged in a predetermined direction on the pressure tray 25 of which the second end part 25*b* moves to the approaching position P1.

The above processing in ACT 1 is ended, and a processing in ACT 3 is executed.

The image forming apparatus 1 reads image data (ACT 3).

For example, the reading of the image data may be carried out by reading a document by the scanner section 15. In this case, the operator places a document on the document table 12 or the ADF 13. After that, the operator carries out an operation input of scan start of the scanner section 15 through the operation section 14. The image data read by the scanner section 15 is stored in the RAM 94 through the I/F 95.

After the image data is read, the processing in ACT 3 is ended, and a processing in ACT 5 is executed.

The operator selects which one of the sheets P housed in the sheet feed cassettes 18A and 18B and the manual sheet feed unit 18C is used by operating the operation section 14 (ACT 5). In this example, the selection of the sheet P placed in the manual sheet feed unit 18C is described.

After the sheet P is selected, the processing in ACT 5 is ended, and a processing in ACT 7 is executed.

The operator inputs an instruction of print start by operating the operation section 14 (ACT 7).

The system control section 92 sends a control signal for starting a warm-up operation of the fixing section 81 to the fixing control circuit 99. The fixing control circuit 99 starts the warm-up operation of the fixing section 81, and lights the halogen lamp. If the warm-up operation is ended, the fixing control circuit 99 sends a conveyance permission signal of the sheet P to the system control section 92.

After the warm-up operation is ended, the processing in ACT 7 is ended, and a processing in ACT 9 is executed.

The feeding of the sheet P selected in ACT 5 to the downstream side is carried out (ACT 9). Specifically, the system control section 92 sends a control signal for starting the feeding of the sheet P to the sheet feed and conveyance control circuit 97. The sheet feed and conveyance control circuit 97 carries out, on the basis of the control signal from the system control section 92, the control for feeding the sheet P from the manual sheet feed unit 18C selected. The sheet P stops in a state where the front end of the sheet P abuts against the register roller 76 at the secondary transfer position b.

The above processing in ACT 9 is ended, and a processing in ACT 11 is executed.

The forming of the toner image on the intermediate transfer belt 53 is started (ACT 11). Specifically, the system control section 92 determines whether or not the conveyance permission signal is received from the fixing control circuit 99. If the conveyance permission signal is received, the system control section 92 sends a control signal for starting the forming of the toner image to the sheet feed and conveyance control circuit 97, the image forming control circuit 98 and the fixing control circuit 99.

The sheet feed and conveyance control circuit 97, the image forming control circuit 98 and the fixing control circuit 99 start control operations in parallel respectively.

The above processing in ACT 11 is ended, and a processing in ACT 13 is executed.

The image forming control circuit 98 sequentially starts image forming processes of the image forming sections 51Y, 51M, 51C and 51K. In the respective image forming sections 51Y, 51M, 51C and 51K, the electrostatic latent images are written on the surfaces of the respective photoconductive drums 56Y, 56M, 56C and 56K by the respective exposure light $L_Y$, $L_M$, $L_C$ and $L_K$ from the exposure device 52. The respective electrostatic latent images are developed by the respective developing devices 58Y, 58M, 58C and 58K.

The toner images are transferred primarily on the intermediate transfer belt 53 by the primary transfer rollers 59Y, 59M, 59C and 59K. Each primary transfer is carried out such that toner image forming areas are overlapped. Each toner image laminated on the intermediate transfer belt 53 is conveyed towards the secondary transfer position b by the intermediate transfer belt 53.

A processing in ACT 13 is carried out in parallel to such an operation of the image forming control circuit 98. The drive motor 97*a* for driving the register roller 76 is driven by the sheet feed and conveyance control circuit 97 at a timing at which the toner image reaches a predetermined position (ACT 13). Rotation of the register roller 76 is started by the drive motor 97*a*. The timing at which the rotation of the register roller 76 is started is a timing at which the front end of the transfer area of the toner image on the sheet P reaches the secondary transfer position b when the front end of the toner image reaches the secondary transfer position b.

The above processing in ACT 13 is ended, and a processing in ACT 15 is executed.

The toner image on the intermediate transfer belt 53 is transferred secondarily on the sheet P (ACT 15). Specifically, the sheet feed and conveyance control circuit 97 rotates the drive roller 69 at a predetermined linear velocity. The image forming control circuit 98 applies the secondary transfer voltage to the secondary transfer roller 71 while the front end of the sheet P reaches the secondary transfer position b. The toner image is transferred secondarily on the sheet P passing through the secondary transfer position b. The sheet P passing through the secondary transfer position b is conveyed towards the fixing section 81 along the conveyance route.

The image forming control circuit 98 stops the application of the secondary transfer voltage after the rear end of the sheet P passes through the secondary transfer position b. The above processing in ACT 15 is ended.

If the sheet P passing through the secondary transfer position b enters the fixing section 81, a processing in ACT 17 is carried out. The toner image is fixed on the sheet P by the fixing section 81 (ACT 17).

The above processing in ACT 17 is ended, and a processing in ACT 19 is executed.

The sheet P is discharged (ACT 19). The sheet P discharged from the fixing section 81 reaches the conveyance roller 82. The conveyance roller 82 discharges the sheet P to the sheet discharge section 83.

The above image formation of one sheet P is ended.

In the conventional sheet feed device, there are problems that the number of components constituting the sheet feed device and the number of rotating shafts around which the link rotates are large, and the sheet feed device becomes complex.

Contrary to this, according to the manual sheet feed unit 18C of the present embodiment, the manual sheet feed unit 18C can be constituted by a small number of components such as the tray receiver 22, the lever 23, the link 24, the pressure tray 25, the engagement mechanism 43, the spring 27 and the correcting section 28. The number of rotating shafts around which the link rotates is only one of connecting portions between the lever 23 and the link 24. However, the manual sheet feed unit 18C can be simply constituted. Since the number of components constituting the manual sheet feed unit 18C is less, the manual sheet feed unit 18C can be miniaturized.

The guide surface 28*b* is formed in the correcting section 28. Thus, the link 24 arranged to be along the direction intersecting with the conveyance direction X can be easily changed to such a direction along the conveyance direction X.

The segment portion 23*a* of the lever 23 and the segment portion 24*b* of the link 24 are engaged in the conveyance orthogonal direction Y. In this way, overall lengths of the lever 23 and the link 24 in the conveyance orthogonal direction Y can be shortened.

It is possible to simply constitute, by the tray side long hole 32*a* of the tray receiver 22 and the lever side protrusion 39 of the lever 23, a mechanism for guiding the lever 23 to move with respect to the tray receiver 22 in the conveyance direction X.

The lever side engagement section 40 is formed on the lever side protrusion 39. Thus, it can be suppressed that the lever side protrusion 39 is detached from the tray receiver 22 in the second direction Y2 in the conveyance orthogonal direction Y.

The lever side engagement section 40 can be inserted into the tray side long hole 32*a* in a direction in which the upper side engagement piece 40*a* and the lower side engagement piece 40*b* are moved to approach each other in the vertical direction. In this way, the lever side engagement section 40 can be easily inserted into the tray side long hole 32*a*.

In the link 24, the large-diameter hole 45 is formed at the end part of the link side long hole 44, and the tray side engagement section 34 is formed on the tray side protrusion 26. Thus, at the time of manufacture of the manual sheet feed unit 18C, the tray side protrusion 26 formed with the tray side engagement section 34 can be inserted into the large-diameter hole 45 of the link 24. Then, the tray side protrusion 26 inserted into the large-diameter hole 45 can be moved within the link side long hole 44.

When the knob 41 is locked to the correcting section 28, the tray side protrusion 26 does not reach the large-diameter hole 45 in the longitudinal direction of the link side long hole 44. In this way, when the tray side protrusion 26 is moved within the link side long hole 44, it can be suppressed that the tray side protrusion 26 is detached from the link side long hole 44.

Further, according to the image forming apparatus 1 of the present embodiment, the image forming apparatus 1 can be constituted with the manual sheet feed unit 18C having a simple constitution.

Furthermore, in the manual sheet feed unit 18C of the present embodiment, the guide surface 28*b* may not be formed in the correcting section 28.

The segment portion 23*a* may not be formed in the lever 23, and the segment portion 24*b* may not be formed in the link 24. In this case, the lever 23 and the link 24 shift positions in the conveyance orthogonal direction Y to be connected.

The mechanism for guiding the lever 23 to move with respect to the tray receiver 22 in the conveyance direction X is constituted by the tray side long hole 32*a* formed in the tray receiver 22 and the lever side protrusion 39 formed in the lever 23. However, this mechanism may be constituted by a well-known slide rail arranged between the tray receiver 22 and the lever 23.

The large-diameter hole 45 may not be formed in the link 24. For example, in this case, after the tray side protrusion 26 on which the tray side engagement section 34 is not formed is inserted into the link side long hole 44, the tray side engagement section 34 is fixed on the tray side protrusion 26.

The lever side engagement section 40 may not be formed on the lever side protrusion 39.

The tray receiver 22 and the pressure tray 25 are arranged along a substantially horizontal plane. However, the tray receiver 22 and the pressure tray 25 may be arranged to be inclined with respect to the horizontal plane.

The manual sheet feed unit 18C may not include the manual sheet feed mechanism 19C.

In the manual sheet feed unit 18C of the present embodiment, since the knob 41 is locked to the correcting section 28, the tray side protrusion 26 does not reach the large-diameter hole 45 in the longitudinal direction of the link side long hole 44. However, since the lever side protrusion 39 comes into contact with the peripheral portion of the opening of the tray side long hole 32*a* in the side wall 32, the tray side protrusion 26 may not reach the large-diameter hole 45 in the longitudinal direction of the link side long hole 44.

Figure 13:
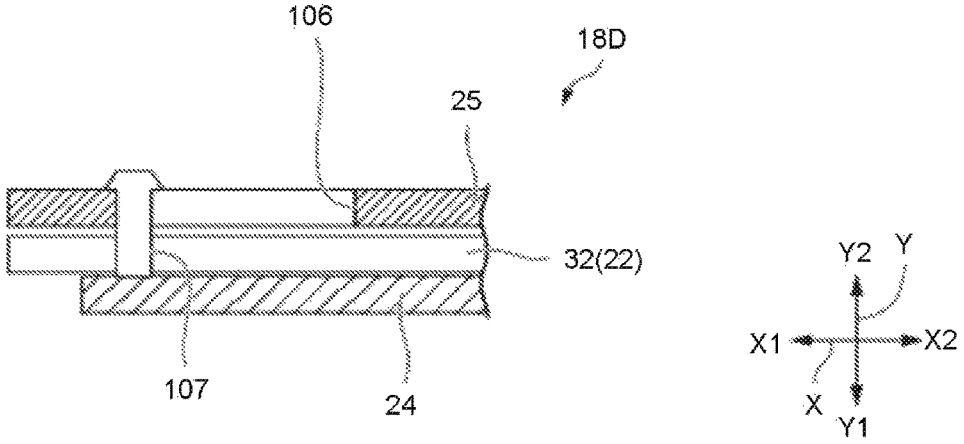
FIG. 13 is a cross-sectional view of a manual sheet feed unit.

The tray side protrusion 26 is formed on the pressure tray 25, and the link side long hole 44 is formed in the link 24. However, as described in a manual sheet feed unit 18D shown in FIG. 13, a tray side long hole (first long hole) 106 extending in the conveyance direction X is formed in the pressure tray 25, and a link side protrusion (first protrusion) 107 inserted into the tray side long hole 106 may be arranged on the link 24. In this way, even if the manual sheet feed unit 18D is constituted, the same effect as the manual sheet feed unit 18C of the present embodiment can be achieved.

The sheet feed device of the present embodiment can also be used in the sheet feed cassettes 18A and 18B, the ADF (automatic document feeder) 13 and a well-known printer device in addition to the manual sheet feed unit 18C.

According to at least one embodiment described above, the manual sheet feed unit 18C can be simply constituted by including the lever 23, the link 24, the engagement mechanism 43, the spring 27 and the correcting section 28.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet feed device, comprising:

a tray receiver section of an image forming apparatus;

a sheet stack section configured to stack a sheet supported rotatably around an axis orthogonal to a sheet conveyance direction with respect to the tray receiver;

a first link guided to move in a conveyance direction of the sheet;

a second link connected rotatably with a conveyance orthogonal direction parallel to the axis as a shaft with respect to the first link;

an engagement mechanism comprising a first long hole and a first protrusion, the first long hole being formed in one of the sheet stack section and the second link to extend in the conveyance direction, the first protrusion being arranged on the other of the sheet stack section and the second link and being movable along a longitudinal direction of the first long hole with respect to the first long hole while being inserted into the first long hole;

an energization section arranged at the tray receiver and configured to energize the sheet stack section to separate the sheet stack section from the tray receiver; and a pressure tray arranged at the tray receiver, the pressure tray comprising a first end part and a second end part, wherein the second end part is movable in an approaching position at which the sheet stack section approaches the tray receiver against an energization force of the energization section while being contactable with the second link in a direction in which the first link moves to a downstream side in the conveyance direction with respect to the tray receiver, and is movable in a separation position at which the sheet stack section is separated from the tray receiver due to the energization force of the energization section while being separated from the second link in a direction in which the first link moves to an upstream side in the conveyance direction with respect to the tray receiver.

2. The sheet feed device according to claim 1, wherein a guide surface opposite to or contacted with the second link is arranged in an end part of a correcting section at the upstream side in the conveyance direction; and the guide surface is inclined, wherein the guide surface is separated from the second link towards the upstream side in the conveyance direction.

3. The sheet feed device according to claim 1, wherein a segment portion of the first link formed at an end part of a part connected with the second link in a first direction in a direction along the axis and a segment portion of the second link formed at an end part of a part connected with the first link in a second direction in the direction along the axis are engaged.

4. The sheet feed device according to claim 1, wherein a second long hole extending in the conveyance direction is formed in the tray receiver;

a plurality of second protrusions is arranged in parallel in the first link in the conveyance direction, the plurality of second protrusions being inserted into the second long hole and being movable with respect to the second long hole along the conveyance direction; and the first link is guided to move with respect to the tray receiver in the conveyance direction by the plurality of second protrusions.

5. The sheet feed device according to claim 4, further comprising:

second engagement sections formed on the plurality of second protrusions and locked to the tray receiver.

6. The sheet feed device according to claim 5, wherein a second engagement section of the second engagement sections comprises a first engagement piece and a second engagement piece arranged spaced apart from each other in a direction along a short diameter of the second long hole; and the second engagement section being inserted into the second long hole in a direction in which the first engagement piece and the second engagement piece are moved to approach each other in the direction along the short diameter.

7. The sheet feed device according to claim 6, wherein the first engagement piece and the second engagement piece are arranged in parallel.

8. The sheet feed device according to claim 1, wherein in the second link, a large-diameter hole with a larger inner diameter than a short diameter of the first long hole is formed in an end part of the first long hole at the downstream side in the conveyance direction; and a first engagement section locked to one of the sheet stack section and the second link and insertable into the large-diameter hole is formed on the first protrusion.

9. The sheet feed device according to claim 8, wherein a locking protrusion protruding from the first link is formed on the first link; and in a direction in which the first link moves with respect to the tray receiver at the upstream side in the conveyance direction, the locking protrusion can be locked to a correcting section, and the first protrusion does not reach the large-diameter hole in the longitudinal direction of the first long hole.

10. The sheet feed device according to claim 1, wherein the first long hole is formed in the second link; and the first protrusion is arranged on the sheet stack section.

11. An image forming apparatus, comprising:

a sheet feed device, comprising:

a tray receiver;

a sheet stack section supported rotatably around an axis with respect to the tray receiver and configured to support a sheet;

a first link guided to move in a conveyance direction of the sheet orthogonal to the axis with respect to the tray receiver;

a second link connected rotatably with a conveyance orthogonal direction parallel to the axis as a shaft with respect to the first link;

an engagement mechanism comprising a first long hole and a first protrusion, the first long hole being formed in one of the sheet stack section and the second link to extend in the conveyance direction, the first protrusion being arranged on the other of the sheet stack section and the second link and being movable along a longitudinal direction of the first long hole with respect to the first long hole while being inserted into the first long hole;

an energization section arranged at the tray receiver and configured to energize the sheet stack section to separate the sheet stack section from the tray receiver; and a pressure tray arranged at the tray receiver and comprising a first end part and a second end part, wherein the second end part is movable in an approaching position at which the sheet stack section approaches the tray receiver against an energization force of the energization section while being contactable with the second link in a direction in which the first link moves to a downstream side in the conveyance direction with respect to the tray receiver, and is movable in a separation position at which the sheet stack section is separated from the tray receiver due to the energization force of the energization section while being separated from the second link in a direction in which the first link moves to an upstream side in the conveyance direction with respect to the tray receiver.

12. The image forming apparatus according to claim 11, wherein a guide surface opposite to or contacted with the second link is arranged in an end part of a correcting section at the upstream side in the conveyance direction; and the guide surface is inclined, and wherein the guide surface is separated from the second link towards the upstream side in the conveyance direction.

13. The image forming apparatus according to claim 11, wherein a segment portion of the first link formed at an end part of a part connected with the second link in a first direction in a direction along the axis and a segment portion of the second link formed at an end part of a part connected with the first link in a second direction in the direction along the axis are engaged.

14. The image forming apparatus according to claim 11, wherein a second long hole extending in the conveyance direction is formed in the tray receiver;

a plurality of second protrusions are is arranged in parallel in the first link in the conveyance direction, the plurality of second protrusions being inserted into the second long hole and being movable with respect to the second long hole along the conveyance direction; and the first link is guided to move with respect to the tray receiver in the conveyance direction by the plurality of second protrusions.

15. The image forming apparatus according to claim 14, further comprising:

second engagement sections formed on the plurality of second protrusions and locked to the tray receiver.

16. The image forming apparatus according to claim 15, wherein a second engagement section of the second engagement sections comprises a first engagement piece and a second engagement piece arranged spaced apart from each other in a direction along a short diameter of the second long hole; and the second engagement section being inserted into the second long hole in a direction in which the first engagement piece and the second engagement piece are moved to approach each other in the direction along the short diameter.

17. The image forming apparatus according to claim 16, wherein the first engagement piece and the second engagement piece are arranged in parallel.

18. The image forming apparatus according to claim 11, wherein in the second link, a large-diameter hole with a larger inner diameter than a short diameter of the first long hole is formed in an end part of the first long hole at the downstream side in the conveyance direction; and a first engagement section locked to one of the sheet stack section and the second link and insertable into the large-diameter hole is formed on the first protrusion.

19. The image forming apparatus according to claim 18, wherein a locking protrusion protruding from the first link is formed on the first link; and in a direction in which the first link moves with respect to the tray receiver at the upstream side in the conveyance direction, the locking protrusion can be locked to a correcting section, and the first protrusion does not reach the large-diameter hole in the longitudinal direction of the first long hole.

20. The image forming apparatus according to claim 11, wherein the first long hole is formed in the second link; and the first protrusion is arranged on the sheet stack section.

* * * * *